US006792995B2

(12) United States Patent
Judkins

(10) Patent No.: US 6,792,995 B2
(45) Date of Patent: Sep. 21, 2004

(54) CORD SHROUD FOR LIFT CORDS AND CORD LOOPS

(76) Inventor: Ren Judkins, 46 Newgate Rd., Pittsburgh, PA (US) 15202

( * ) Notice: Subject to any disclaimer, the term of this patent is extended or adjusted under 35 U.S.C. 154(b) by 0 days.

(21) Appl. No.: 10/289,577

(22) Filed: Nov. 7, 2002

(65) Prior Publication Data

US 2004/0089428 A1 May 13, 2004

(51) Int. Cl.[7] ..... E06B 9/326
(52) U.S. Cl. ..... 160/84.04; 160/173 R
(58) Field of Search ..... 160/168.1 R, 173 R, 160/178.1 R, 178.3 R, 172 R

(56) References Cited

U.S. PATENT DOCUMENTS 4,909,298 A 3/1990 Langhart et al.
5,465,775 A * 11/1995 Biba et al. ..... 160/168.1 R
5,472,035 A * 12/1995 Biba et al. ..... 160/168.1 R
5,495,883 A 3/1996 Jelic
5,553,650 A 9/1996 Jelic
5,577,543 A 11/1996 Jelic
5,613,540 A 3/1997 Jelic
5,722,478 A * 3/1998 Claypool et al. ..... 160/173 R

* cited by examiner

*Primary Examiner*—Blair M. Johnson
(74) *Attorney, Agent, or Firm*—Buchanan Ingersoll, PC

(57) ABSTRACT

A cord shroud for use in cooperation with a window shade assembly of the type having multiple lift cords or a cord loop extending from a headrail has two elongated flexible ribbons, each ribbon having a plurality of apertures sized to permit the lift cords to pass through the apertures. The first end of one ribbon is connected to the headrail or to a tube extending from the headrail. A gripper is attached to the second end of the first ribbon and attached to the first end of the second ribbon. The second end of the second ribbon can be attached to a tassel or a weight. The gripper has a passageway through which the lift cords pass and is constructed such that the cords can pass freely through the passageway when the gripper is in a relaxed condition. The gripper will grip a portion of the lift cords that is in the passageway when a force is applied to the gripper.

45 Claims, 9 Drawing Sheets

CORD SHROUD FOR LIFT CORDS AND CORD LOOPS

BACKGROUND OF THE INVENTION

1. Field of the Invention

This invention relates generally to safety devices used on lift cords in pleated shades, venetian blinds and other window covering products and to window covering products having such safety devices.

2. Description of the Prior Art

Window shade assemblies and venetian blinds typically have window covering material or blind slats extending between a headrail and a bottomrail. In many of these products the window covering material or blind slats are raised and lowered by two or more lift cords or a cord loop extending from the headrail. In those products that have multiple lift cords the lift cords are connected at one end to the bottomrail and extend up through the window covering material or blind slats into the headrail. The lift cords then pass through a cord-locking device and out of the headrail such that an opposite end of the lift cords is accessible to an operator. Window shades and blinds of this type are typically raised by the operator pulling on the accessible portion of the lift cords and are lowered by releasing the lift cords. Because all lift cords must move in unison, the lift cords are typically tied together and the tied end is attached to a tassel. The lift cords often extend downward from the headrail to within a few feet of floor level.

In some window covering products the lift cords extend from the bottom of the window covering material into the headrail where they are wound around an axle. A cord loop is often provided around one end of the axle and extends from the headrail. An operator can raise and lower the window covering material by pulling the loop in a manner to cause the axle to turn in a desired direction. This type of prior art window covering is shown in FIG. 1.

The lift cords and cord loops of a window shade assembly present an attractive danger to infants or children who may play with the lift cords. There have been several instances in which children and infants have become entangled in the cords and accidentally hanged. These incidents prompted the Window Covering Manufacturers Association to develop standards for window coverings. These standards say that window coverings should not have accessible cord loops, or if such loops are present the loops must have a safety device that prevents entanglement.

One solution to this problem has been focused on a detachable connection of the lift cords. In U.S. Pat. No. 4,909,298 Langhart et al. discloses a breakaway tassel that is attached to multiple lift cords. The tassel is designed to enable the cords to separate into individual cords with free ends when subjected to a force. However, tests of a commercially available embodiment of the Langhart patent have shown that this product failed to detach in simulated entanglements. Then the manufacturer changed the product to the extent that the tassel often comes apart during normal use. When that happens people tie the cords together. Jelic in U.S. Pat. Nos. 5,553,650 and 5,577,543 provides a somewhat similar solution. Those patents disclose safety devices for a cord loop in which a blade cuts the loop when a force is applied to the device. None of the devices disclosed in these two patents were ever commercialized.

Another type of cord safety device is a shroud that extends from the headrail to a handle or tassel capturing all of the lift cords within the shroud. Jelic discloses a ribbon used as a cord shroud in U.S. Pat. No. 5,495,883 and a cord ladder used as a cord shroud in U.S. Pat. No. 5,613,540. When these safety devices are used the operator must pull the cords at their distal ends where the handle or tassel is located to raise and lower the window covering material. This can be very inconvenient for a long blind because the operator is required to lean over and/or walk several feet away from the window to fully raise the blind keeping the cord taut as he or she pulls the cord. The cord shrouds disclosed by Jelic are also not suitable for use on a cord loop and have never been commercialized. Consequently, there is a need for a cord shroud system in which an operator is able to pull the lift cords from a position intermediate the headrail and the distal ends of the cord. There is also a need for a cord shroud that can be used on a cord loop.

SUMMARY OF THE INVENTION

I provide a cord shroud for use in cooperation with a window shade assembly of the type having multiple lift cords or a cord loop extending from a headrail. I also provide a window covering of the type having lift cords in which the lift cords exit the headrail and pass through a cord capture device. The cord capture device has a fixed end and a moveable end. The fixed end need not be attached to the headrail. Instead the fixed end can be attached to the end of at least one lift cord or attached to the end of a release cord or other structure that is located at a point that is a selected distance from the headrail. In those embodiments where the fixed end is not attached to the end of the lifts cords, the fixed end will be at a point that is fixed relative to the headrail. The moveable end is moveable relative to the headrail, relative to all points on the lift cords and relative to the end of the release cord or other structure to which the fixed end is attached. The cord capture device or cord can be one of a number of structures having a plurality of apertures through which the lift cords pass.

In one embodiment the cord shroud has two elongated flexible ribbons, each ribbon having a plurality of apertures sized to permit the lift cords to pass through the apertures. The first end of one ribbon is connected to the headrail, to the handle of a release cord or to a tube extending from the headrail. I also provide a gripper attached to the second end of the first ribbon and attached to the first end of the second ribbon. The second end of the second ribbon can be attached to a tassel or a weight that is connected to the end of the lift cords or to the lowest portion of a cord loop. The gripper has a passageway through which the lift cords or the cord loop pass and is constructed such that the lift cords can pass freely through the passageway when the gripper is in a relaxed condition. The gripper will either allow the user to grip the lift cords while holding the gripper or the gripper itself will grip a portion of the lift cords that is in the passageway. Gripping may be accomplished through a spring-actuated plunger or when a force is applied to the gripper. If desired, an elastic retracting cord can be provided to return the gripper to its original position after each pull. Then the first ribbon is not required. When an operator wishes to raise a window covering he or she preferably squeezes the gripper and pulls the lift cords a comfortable distance. To continue raising the blind the operator slides the gripper up the lift cords toward the headrail without squeezing the gripper, then squeezes the gripper and pulls again. This process is repeated until the blind has been raised a desired amount. A cord lock or axle lock in the headrail locks the lift cords in place when the operator stops pulling the cords. Any conventional cord lock can be used. However, I prefer to provide a cord lock that automatically locks unless released by a mechanical linkage that is operated by a release. A shroud may be provided between the headrail and the release handle at the end of the release linkage. In this embodiment the first ribbon extends from the handle to the gripper.

I prefer that the gripper be a hollow ellipsoid or elliptical strap with a hole at each end through which the lift cords pass. The ellipsoid is made of a flexible material such as rubber. I also prefer to provide a finger loop on the gripper. Alternatively, the gripper may have a cam lock, which is closed to grip the cords and opened to allow free passage of the cords through the gripper.

The ribbons can be a strip of any suitable material including fabric, plastic, paper or even a cord. The ribbon material may be selected to match the window covering material. The apertures could be holes through the ribbon or provided by loops or rings attached to the ribbon or cord. I prefer to accordion pleat the ribbon. A fabric, paper or plastic ribbon may also be pleated such that each pleat terminates in a tab and the apertures are provided through the tabs. Yet, another alternative is to use a cord ladder for the ribbon. Still another alternative is a single cord having spaced-apart loops through which the lift cords are routed. Yet, another alternative is to use a coiled cord similar to the cords used to connect a telephone receiver to the main unit.

Other objects and advantages of the invention will become apparent from a description of certain present preferred embodiments thereof shown in the drawings.

DETAILED DESCRIPTION OF THE PREFERRED EMBODIMENTS

The present invention can be used with any type of window covering which uses lift cords including pleated shades, roman shades and venetian blinds. Although the present preferred embodiments are shown and described in use with pleated shades, the invention is not limited thereto.

Figure 1:
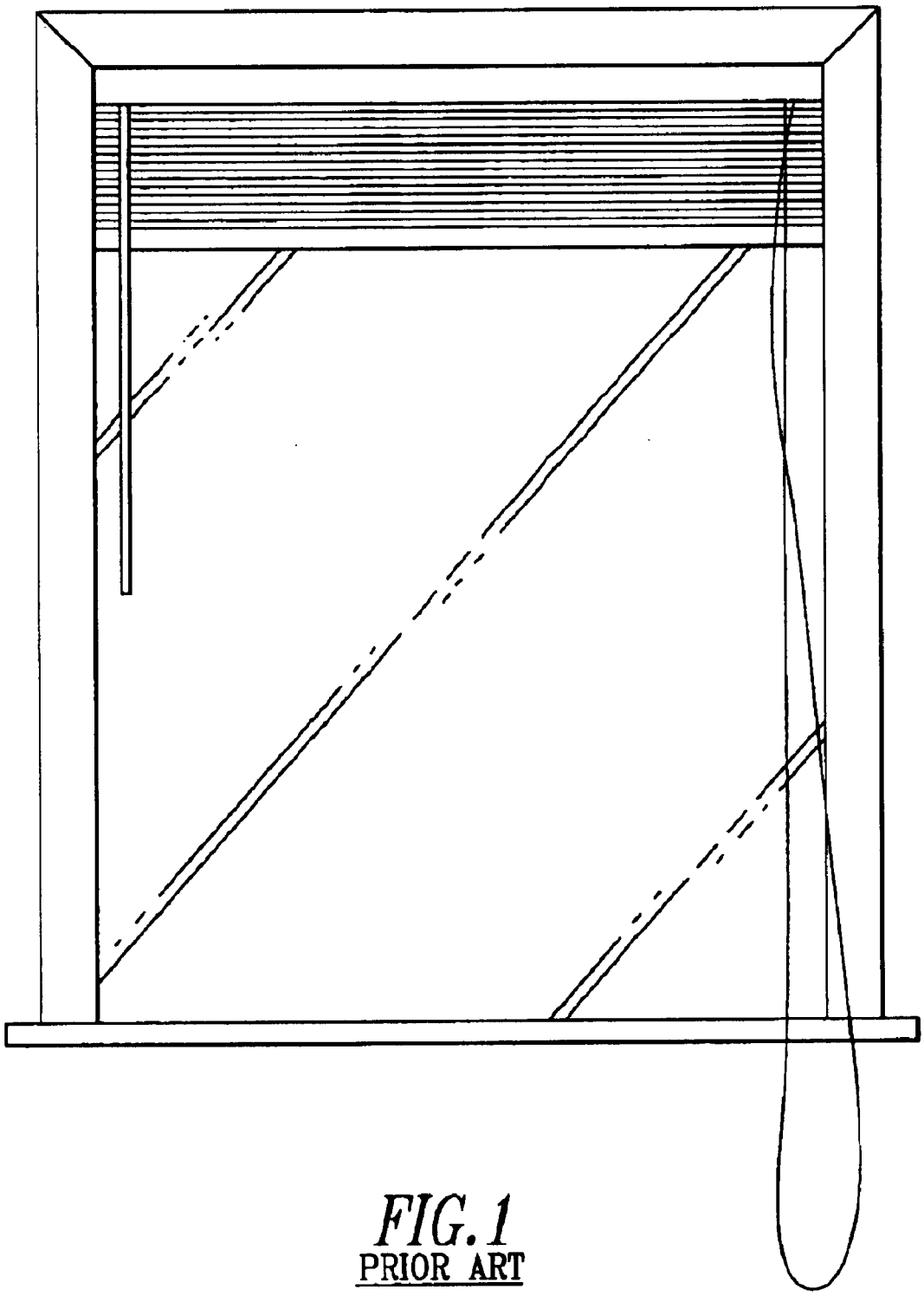
FIG. 1 PRIOR ART
FIG. 1 is a prior art window shade assembly affixed to a window and in a fully raised position showing the cord loop used to raise and lower the window covering material.
Figure 2:
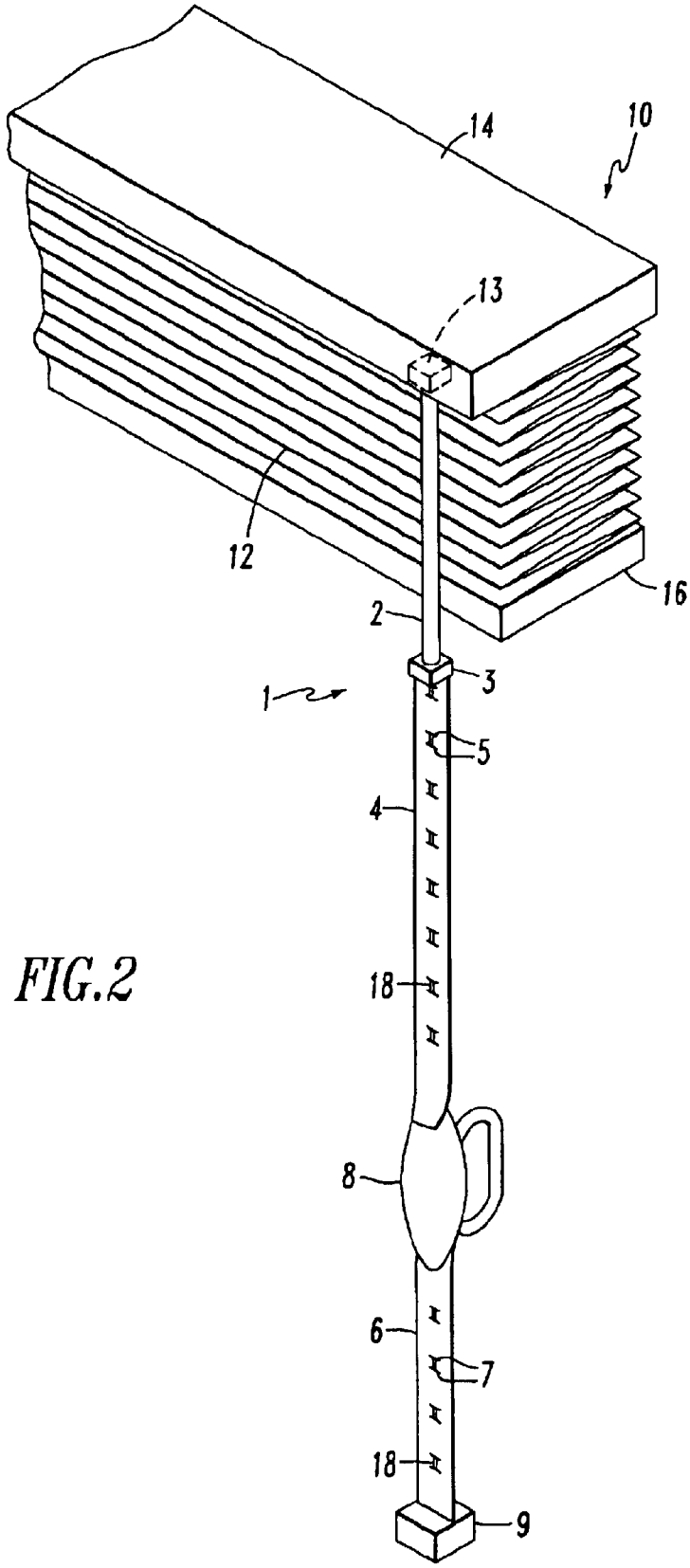
FIG. 2 is a perspective view of a first present preferred lift cord shroud cooperating with a window shade assembly in which the window shade is in a fully raised position.
Figure 3:
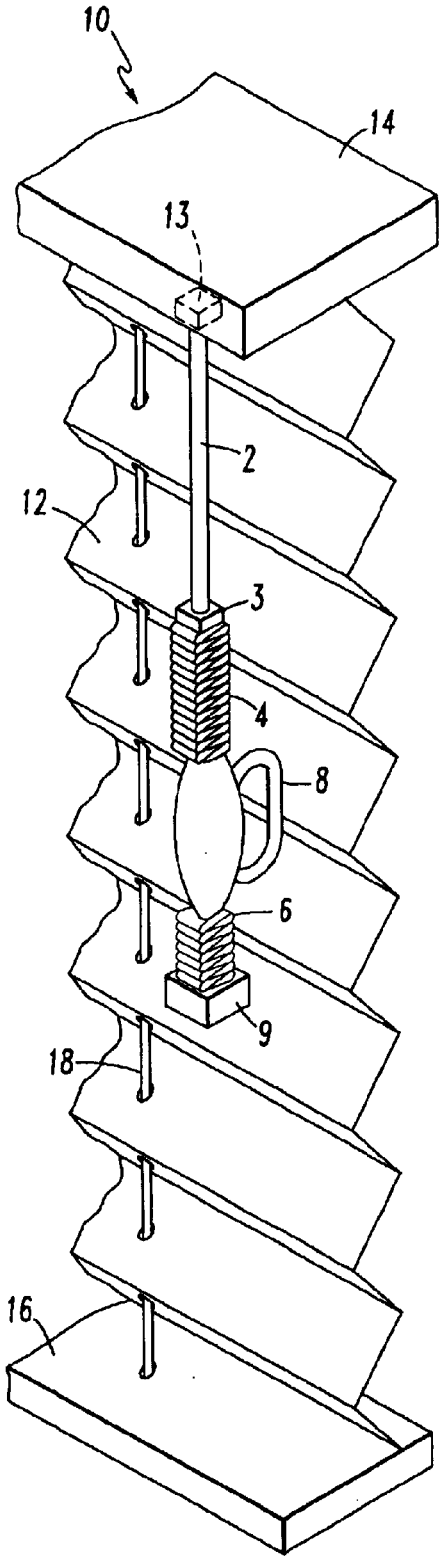
FIG. 3 is a view similar to FIG. 2 in which the window shade is in a fully lowered position.
Figure 4:
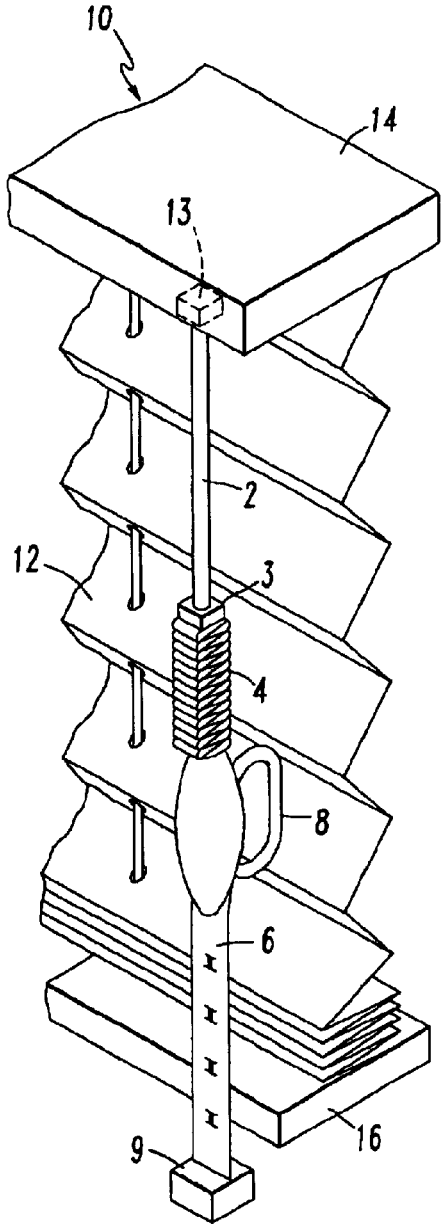
FIG. 4 is a perspective view similar to FIGS. 2 and 3 in which the window shade is in a partially raised position.

Referring first to FIGS. 2, 3 and 4, the cord shroud 1 is used in cooperation with a window shade assembly 10. The window shade assembly 10 is of the type having a bottomrail 16 and a headrail 14 and a window covering material 12 provided therebetween. The window shade assembly 10 has a cord lock 13 within and attached to the headrail 14. The window shade assembly 10 further has at least two lift cords 18. Each of the lift cords 18 is connected at one end to the bottomrail 16, passes through window covering material 12, continues through the headrail 14 and cord lock 13 and exits the headrail to have an opposite end that is accessible to an operator. The portions of the lift cords 18 that extend from the headrail are contained within the cord shroud 1.

A first present preferred embodiment of my cord shroud 1 has a tube 2 attached to the cord lock 13 or the bottom of the headrail 14 at a point below the cord lock. A cord lock release handle 3 is attached to the opposite end of the tube 2. A first ribbon 4 extends from the cord lock release handle 3 to a gripper 8. A second ribbon 6 extends from the gripper to a tassel or weight 9 to which the ends of the lift cords 18 are attached. The ribbons are flexible and can be of the type used to decorate hats, other clothing and packages. The ribbons 4, 6 each have a plurality of apertures 5, 7 disposed along the length of the ribbons 4, 6 and through which the lift cords 18 pass. In this embodiment the tube and the ribbons have a combined length sufficient to fit over substantially all of those portions of the lift cords 18 which extend from the headrail when the window covering material is in a fully raised position shown in FIG. 2. The ends of the lift cords 18 are attached to tassel 9. Thus, pulling the lift cords 18 to lift the window shade 12 simultaneously lengthens at least one of the ribbons. The tassel 9 is preferably lightweight, such as by being made of plastic or metal and being hollow. The tassel 9 could be a cord reel on which the lift cords are wound. The ribbons are connected to the cord release, gripper and tassel by any convenient means such as gluing.

The window shade is lowered from the fully raised position shown in FIG. 2 to a fully lowered position shown in FIG. 3 by releasing the cord lock 13. The lift cords 18 are then free to move and the weight of the bottomrail 16 will cause the window covering material 12 to descend. Although any conventional cord lock could be used, I prefer to provide a cord lock of the type that is activated by a release cord. As shown most clearly in FIG. 5, the cord lock 13 contains a surface 36 over which the lift cords pass. A locking bar 38 is pressed toward surface 36 by a spring 39 locking the lift cords 18 between surface 36 and bar 38. A release cord 33 extends from the locking bar 38 through tube 2 and is attached to the lower half 32 of the cord release unit 3. Pulling the lower half 32 away from the upper half 31 of the cord release unit 3 pulls release cord 33. Downward motion of the release cord 33 causes the locking bar 38 to pivot away from surface 36 allowing the lift cords 18 to move freely. When the lower half 32 is released spring 39 causes bar 38 to return to a locked position pulling release cord and lower half 32 upward. Tube 2 is selected to be of such a length that an operator of the window covering product can easily reach the release unit 3. The tube need not be attached to the headrail.

Figure 6:
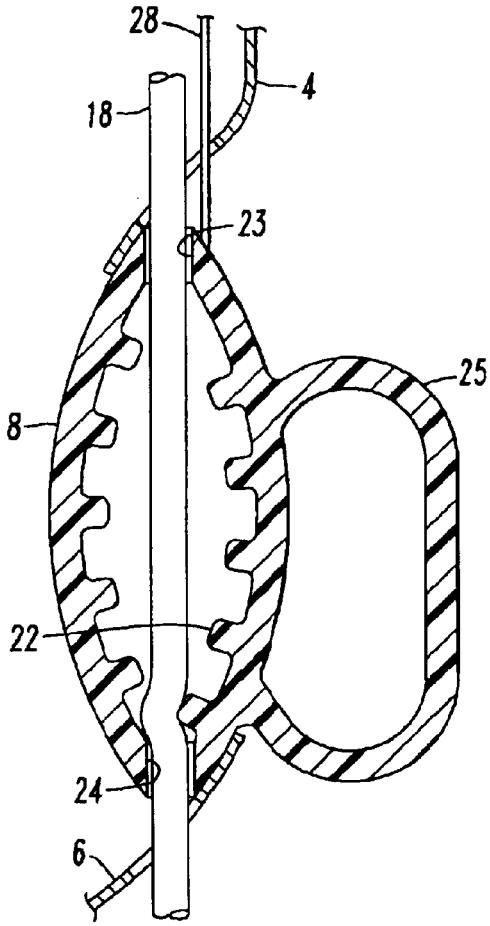
FIG. 6 is a sectional view of a portion of the gripper in the first preferred embodiment of the lift cord shroud shown in FIGS. 2, 3, 4.

To raise the blind an operator squeezes the gripper 8. As shown in FIG. 6 the gripper is hollow and preferably has teeth 22 on its inner surface. A finger loop 25 may be provided on the gripper 8. Squeezing the gripper 8 causes the teeth 22 and inner surface of the gripper to press against the lift cords 18. Consequently, the operator can now pull the lift cords downward thereby causing the window covering material to rise. After the operator has pulled the lift cords a convenient distance while squeezing the gripper he or she then releases the gripping force so that the lift cords 18 can freely pass through the holes 23 and 24 at opposite ends of the gripper. If the window covering has not been raised a sufficient amount the operator can slide the gripper up the lift cords to a position shown in FIG. 4, squeeze the gripper and pull again. These steps can be repeated until the window covering has been raised to a desired position. As previously mentioned the combined length of the ribbons must be sufficient to cover the length of lift cords that can be pulled from the headrail when the shade is raised from a fully lowered position shown in FIG. 3 to a fully raised position shown in FIG. 2. As should be apparent from a comparison of FIGS. 2 and 3, that combined length will be the length of the shade minus the length of the stack. The length of one ribbon must be at least as long as the desired amount of travel of the gripper during a single stroke. The second ribbon could be longer or shorter.

Figure 5:
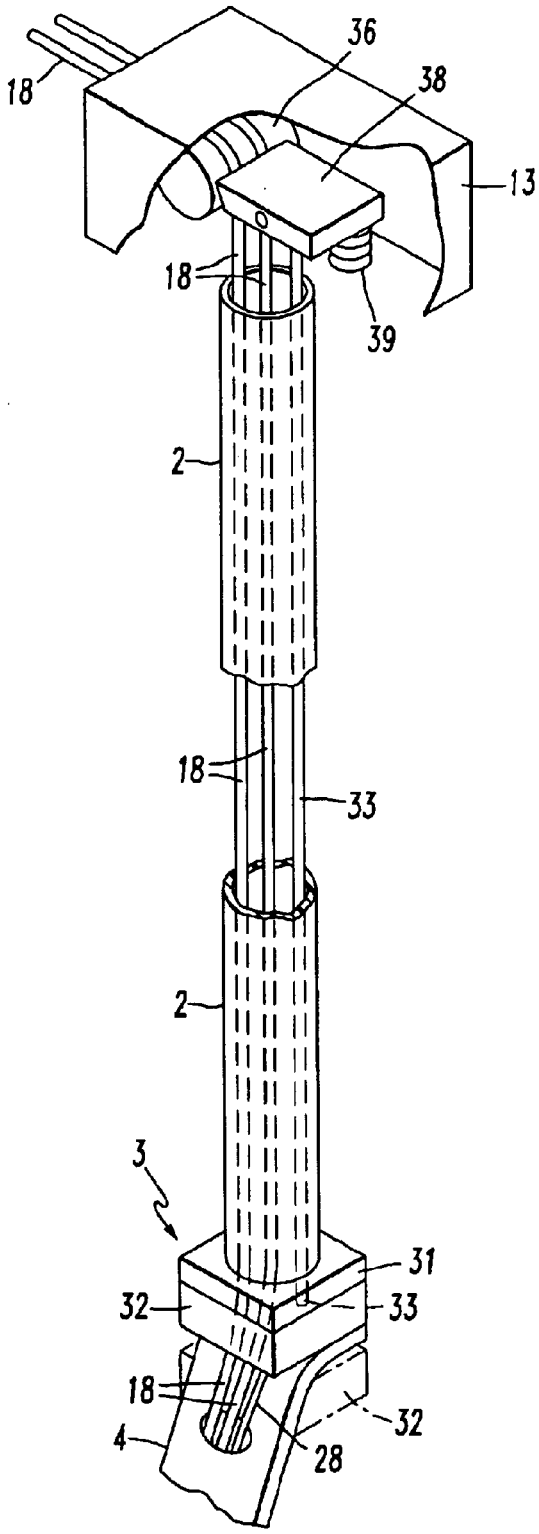
FIG. 5 is an enlarged perspective view showing the tube and cord lock release unit of the embodiments of FIGS. 2, 3 and 4 connected to a cord lock.

I prefer to provide an elastic cord 28 attached between the top of the gripper 8 and the bottom half 32 of the cord lock release as shown in FIGS. 5 and 6. The elastic cord pulls the gripper back toward the cord release unit to a position such as shown in FIG. 4. It should be apparent from FIGS. 2 through 6 that when an elastic cord 28 is attached to the gripper the first ribbon can be eliminated. In that embodiment the gripper 8 would normally be adjacent the cord release handle 3 and there would be a single ribbon 6 or other cord capture device attached between the gripper 8 and the tassel 9. The operator would squeeze the gripper to pull the lift cord as in the previous embodiment. When the operator released the gripper 8 the elastic cord 28 would return the gripper to its initial position adjacent the cord release handle 3.

Figure 7:
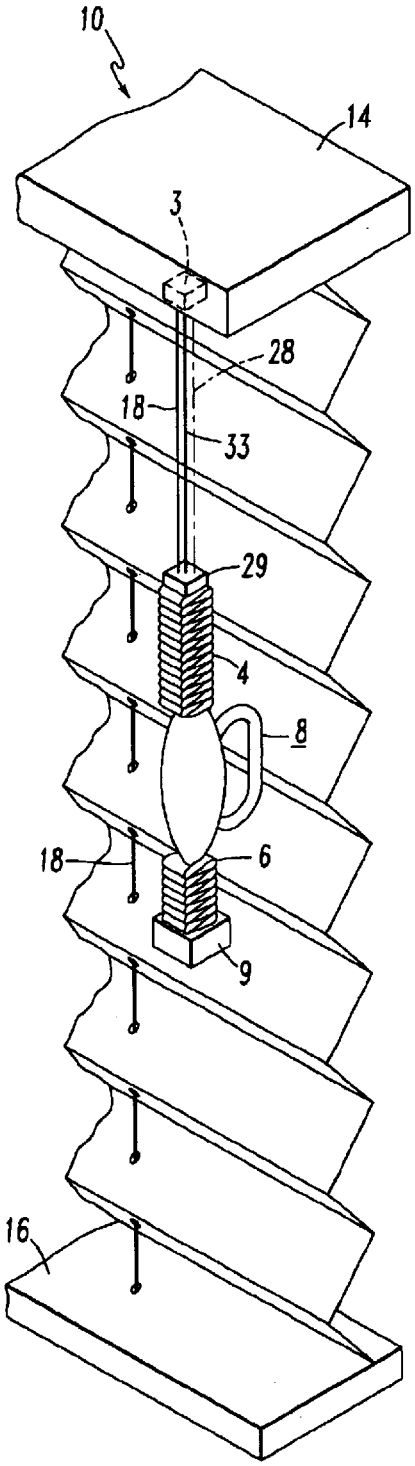
FIG. 7 is a perspective view of a second present preferred embodiment of my cord shroud that does not contain a tube.

A similar embodiment shown in FIG. 7 has no tube. The lift cords 18 extend from the headrail 14 through a cord release handle 29, a first ribbon 4, gripper 8 and second ribbon 6 to a weight or tassel 9. As in the first embodiment, the second ribbon is attached to the gripper at one end and to the tassel at the opposite end. The first ribbon is attached to the cord release handle 29 and to the gripper. The release cord 33 runs from the cord lock 3, inside the headrail to the release handle 29. An elastic cord 28 could be attached between the headrail and the gripper 8. The visible portion of elastic cord 28 is shown in chain line in FIG. 7 to distinguish that elastic cord from the lift cords 18. In most installations, the portions of the cords between the headrail and the release handle should be high enough to pose no danger to children or pets becoming entangled in them. Therefore, it is not necessary to shroud those cord segments.

The ribbons shown in the embodiment of FIGS. 2, 3, 4 and 7 are simply flat sections of material. However, the shape, size and type of flexible material utilized for the ribbon may be varied while remaining within the scope of the present invention. The apertures 5, 7 are generally transverse slits provided along the length of the ribbon. The lift cords 18 enter one aperture from a front face of the ribbon and then enter the next aperture from the rear face of the ribbon. In this way, the lift cords 18 are woven through the apertures. Consequently, the lift cords 18 are prevented from separating and forming a loop. When the shade assembly 10 is in the fully raised position and the ribbons are fully extended as shown in FIG. 2. When the shade assembly 10 is lowered to the closed position the ribbons are folded over as shown in FIG. 3 and the lift cords 18 remain restrained by the ribbons. The size, shape and positioning of the apertures along the ribbon 4 or 6 may also be varied. Rather than being slits, the apertures 5, 7 could be generally circular holes. A separate set of holes could be provided for each cord 18.

Figure 8:
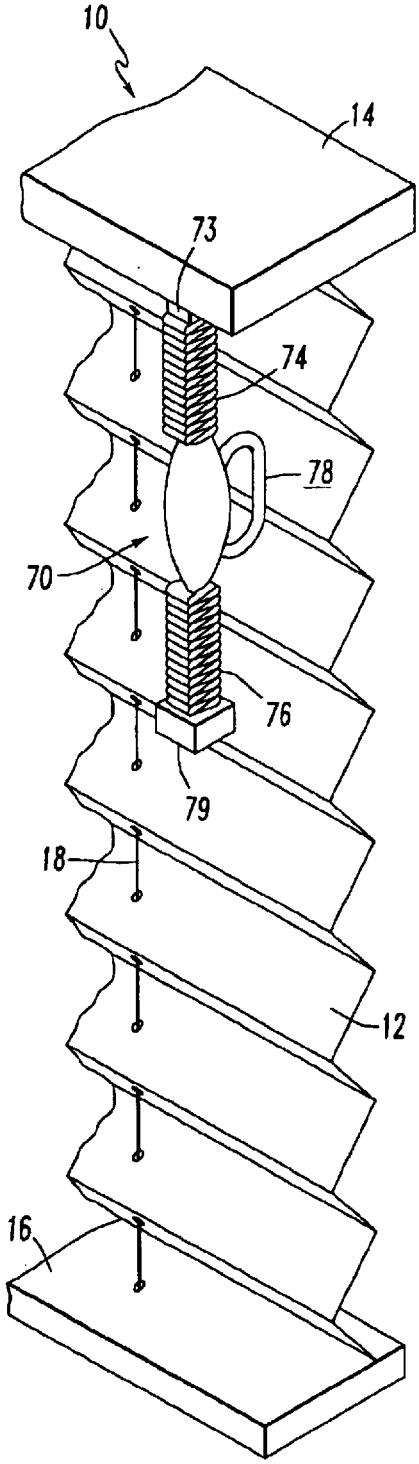
FIG. 8 is a perspective view of a third present preferred embodiment of my cord shroud.

In FIG. 8 there is shown an embodiment 70 in which the first ribbon 74 is attached between a cord lock 73 and gripper 78. A second ribbon 76 is attached between the gripper 78 and tassel or weight 79. This shroud 70 operates in the same manner as the embodiment shown in FIGS. 2, 3, and 4.

Figure 9:
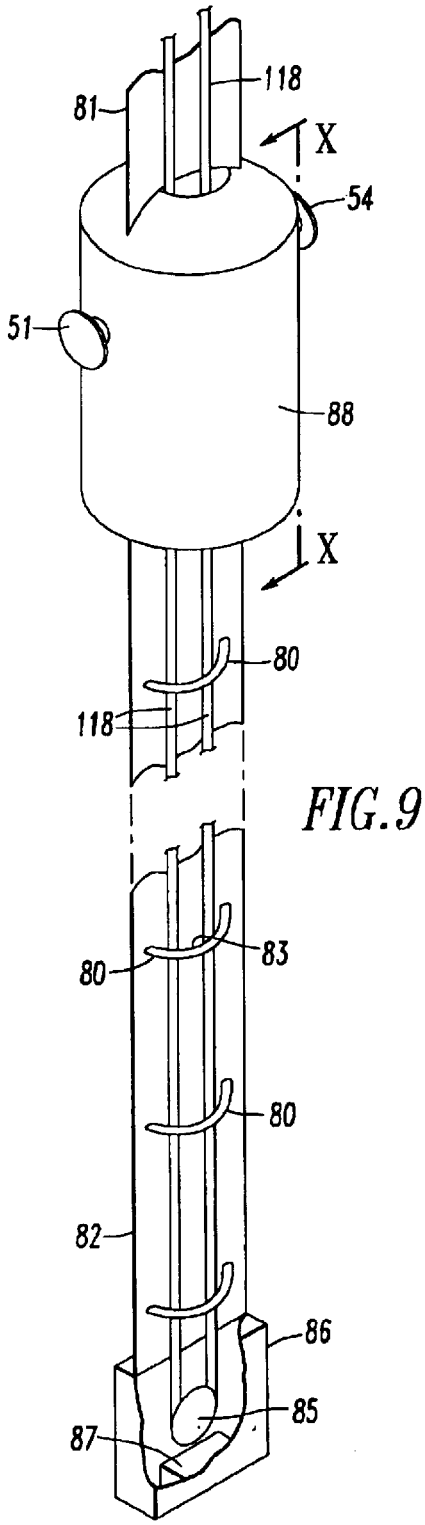
FIG. 9 is a perspective view of a fourth present preferred embodiment of my cord shroud suitable for use on a cord loop.
Figure 10:
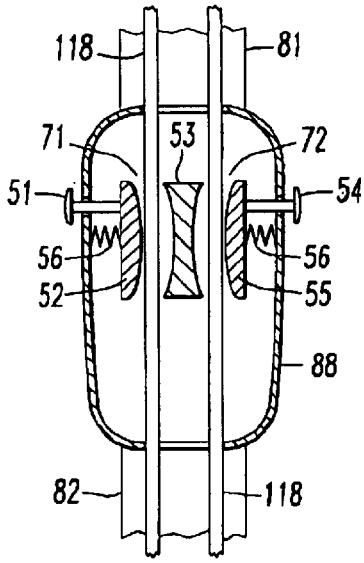
FIG. 10 is a sectional view of the gripper taken along the line X—X in FIG. 8.
Figure 11:
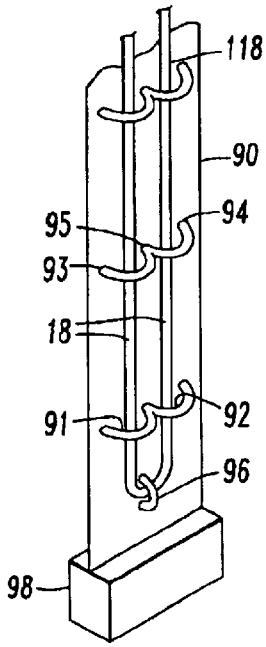
FIG. 11 is a front view of an alternative embodiment of the second ribbon used in the cord shroud shown in FIG. 9.
Figure 18:
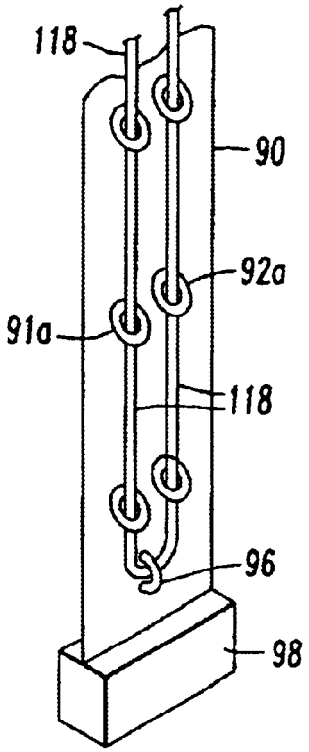
FIG. 18 is a front view similar to FIG. 11 of the cord shroud having rings rather than cord loops.

In other preferred cord shrouds shown in FIGS. 9 and 11, the apertures 83, 91, 92 are provided by a plurality of loops 80, 96, 97 spaced-apart and attached to the ribbons 4, 6. The ribbon is preferably a flat section of material. It is also preferred that each loop 80 is a relatively thin section of material or cord that is sewn or otherwise attached to the ribbon at opposed ends of the loop. Thus, lift cords may be routed between the portion of the loops between the opposed loop ends and the ribbon. The loops may be formed of any material such as metal, plastic or fabric. In addition, the loops may be shaped and attached to the ribbon in such a manner so as to form two or more apertures 91, 92 as is shown in FIG. 11. In this embodiment, the cords cannot be twisted or wrapped around one another. One way to form two or more apertures from each loop is to sew or otherwise affix the loop to the ribbon 4, 6 at the intermediate loop portion. It is possible to form the loops by attaching a plurality of rings to the ribbons 4, 6 at spaced-intervals. Each ring should be relatively thin and lightweight. As shown in FIG. 18, two or more rings 91*a*, 92*a* may be provided side by side along the length of the ribbon, so that two or more sets of apertures are provided along the length of the ribbon.

Figure 19:
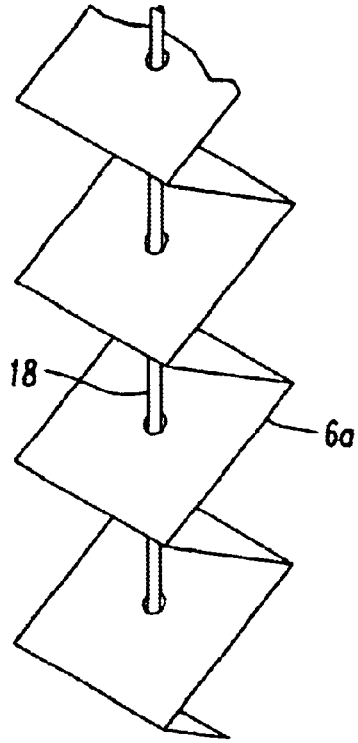
FIG. 19 is a fragmentary view of a portion of a pleated ribbon that can be used in place of the ribbons illustrated in FIGS. 2, 3 and 4.

The ribbon can be folded or creased so as to have a series of transverse pleats provided thereon to alternate in opposite directions. A portion of such a ribbon 6*a* is illustrated in FIG. 19. In yet another embodiment the ribbon is pleated in a manner to form tabs on every other pleat. The apertures are formed in the tabs. Yet another alternative is to use ladders as the ribbons. The lift cords are laced through or between the rungs of ladders.

Figure 20:
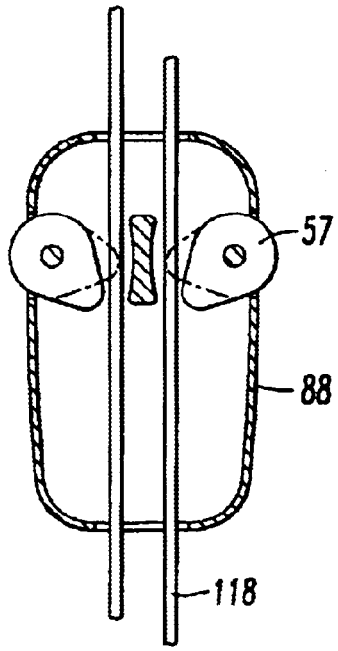
FIG. 20 is a sectional view similar to FIG. 10 of a second embodiment of a gripper that has a cam lock with the locked position of the cam shown in dotted line.

The cord shrouds 80 and 90 shown in FIGS. 9, 11 and 18 are configured for a cord loop 118. Referring to FIG. 9, housing 86 contains a pulley 85 and a weight 87 below the pulley. The cord loop 118 passes from the headrail (not shown), through an optional tube (also not shown), through the first ribbon 81 through the gripper 88 along a first channel or passageway 71, through apertures 83 in the second ribbon, around the pulley 85, back through apertures 83, through passageway 72 in the gripper 88, through the first ribbon 81 and into the headrail to complete the cord loop. When a user presses button 51 on the gripper 88, plunger 52 is pressed toward anvil 53 gripping a portion of the cord loop. The user then pulls down causing the cord loop 118 to move and rotate the axle carrying the lift cords in the headrail in the first direction. Passageway 72 is open allowing the cord loop to freely move through that channel. To rotate the axle in an opposite direction the user presses button 54 causing plunger 55 to close channel 72 gripping a portion of the cord loop 118 against the anvil 53. Then the operator pulls the gripper down. Channel 71 is now open allowing the cord loop to move through that passageway. Springs 56 maintain the plungers in an open position when no force is applied to a button. The plungers could be configured as a cam lock 57 shown in FIG. 20. The buttons 51 and 52 could be coded by using different colors, different shapes or other markings to indicate which button should be pressed to raise the blind and which button should be pressed to lower the blind.

One could substitute the ribbon 90 with weight 98 shown in FIG. 11 for the second ribbon 82 with housing 86 and pulley 85 shown in FIG. 9. This ribbon 90 has loops that form two separate apertures because the ends 93 and 94 of the loop as well as the center 95 of each loop are attached to the ribbon. A transition loop 96 with a single opening is provided near the bottom of the ribbon 90. The bottom of the ribbon 90 is attached to a weight 98. The cord loop is routed through the first set of apertures 91, through loop 96 and then through the second set of apertures 94. Thus, the end of the cord loop 118 is at loop 96, whereas the end of the cord loop in the embodiment of FIG. 9 was around the pulley. Of course metal rings could be used for any and all of these loops. One such embodiment having rings 91*a* and 92*a* is shown in FIG. 18.

Figure 12:
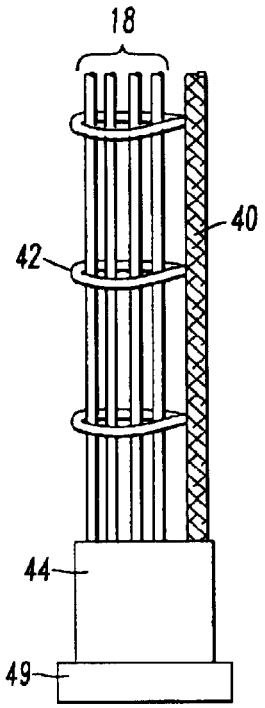
FIG. 12 is a front elevational view of a portion of an alternative embodiment in which a cord with loops is used in place of the ribbon.

In all of the embodiments illustrated in FIGS. 2 through 11 a ribbon or tube is provided to shroud or capture the lift cords. However, other structures could be used. A woven cord 40 that could be called a base cord having a series of aligned, spaced-apart loops 42 as shown in FIG. 12 could be used. The lift cords 18 are routed through the loops as shown. One disadvantage of this cord 40 with loops 42 is that the cord tends not to fold as neatly as a ribbon. Therefore, I prefer to provide a tubular collector 44 on the structure 49 to which the lower end of the cord 40 is attached. That structure could be the cord release handle, gripper or tassel. As this structure 49 is raised the cord 40 will collect within the tubular collector 44.

Figure 13:
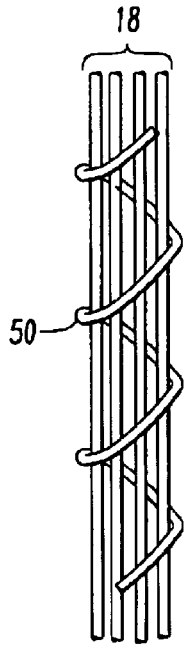
FIG. 13 is a front elevational view of a portion of another embodiment that uses a coiled cord in place of the ribbon.

Another alternative is to substitute a coiled cord 50 shown in FIG. 13 for the ribbon. Lift cords 18 will pass through the center of the aligned loops formed by the coil. The coiled cord may be similar in appearance to the cord that runs between a handset or receiver and the main unit of a telephone or mobile radio.

Figure 14:
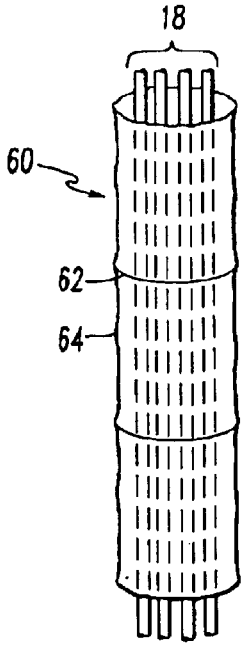
FIG. 14 is a front elevational view of a portion of yet another embodiment that uses a collapsible tube in place of the ribbon.
Figure 15:
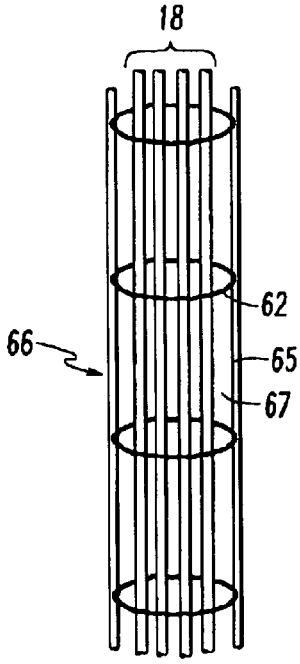
FIG. 15 is a front elevational view of a portion of yet another embodiment similar to the embodiment of FIG. 14 that uses a collapsible tube formed by a series or rings connected by spaced apart threads or cords.

Still another alternative is to use a collapsible tube 60 such as is shown in FIG. 14. This tube may have a series of rings 62 along a tube of flexible material 64. Another collapsible tube 66 is be formed by rings 62 connected by a series of spaced apart longitudinal threads 65 as shown in FIG. 15. There are openings 67 between the longitudinal threads.

One could choose to use two longitudinal threads 65 and make the rings of a similar thread material. That configuration would resemble a ladder in which threads 65 are the rails and the threads that form the rings 62 are the rungs. The lift cords 118 could be threaded through the rungs 62, or be woven around the rungs so that the lift cords pass in front of one rung then behind an adjacent rung, then in front of the next rung, continuing the pattern alone the length of the ladder.

The collapsible tube, cord with loops and ladder forms of the cord shroud could be substituted for either or both of the ribbons shown in FIGS. 2, 3, 4, 7 and 8. Consequently, the cord shroud could have two ribbons, one ribbon and any one of a collapsible tube, a cord with loops and a ladder, two collapsible tubes, two cords with loops or two ladders.

Figure 16:
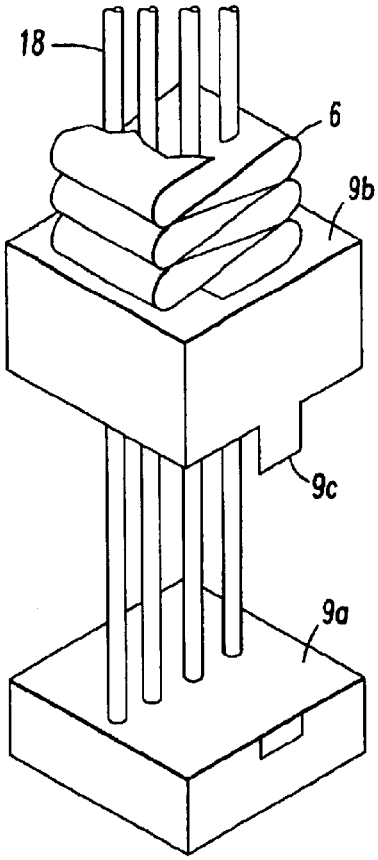
FIG. 16 is a perspective view of another embodiment of my cord shroud.

The cord capture device or shroud could be constructed so that the movable end is detachable from the release cord handle or the tassel. As shown in FIG. 16 the tassel or weight 9 to which the ribbon 6 is attached can be made in two pieces 9*a* and 9*b*. The upper part 9*b* is flexible or contains a plunger or other structure so that the lift cords are gripped when that upper piece is squeezed and the lift cords freely pass when no force is applied to the upper piece 9*b*. To raise the window covering the operator slides the upper piece upward toward the headrail exposing a portion of the lift cords as shown in FIG. 16. Then a force is applied to the upper part 9*b* to grip the lift cords and the operator pulls down causing the window covering to rise. The upper part 9*a* may be weighted to assure that it falls to a position on the lower part 9*b* when not in use. If desired a locking means such as tabs 9*c* may be provided to lock the two parts together in a manner making it difficult for children but easy for adults to separate the two parts. Of course, a similar configuration could be used to releasably attach the cord capture device to other structures such as the handle of a release cord or a tube extending from the headrail.

Figure 17:
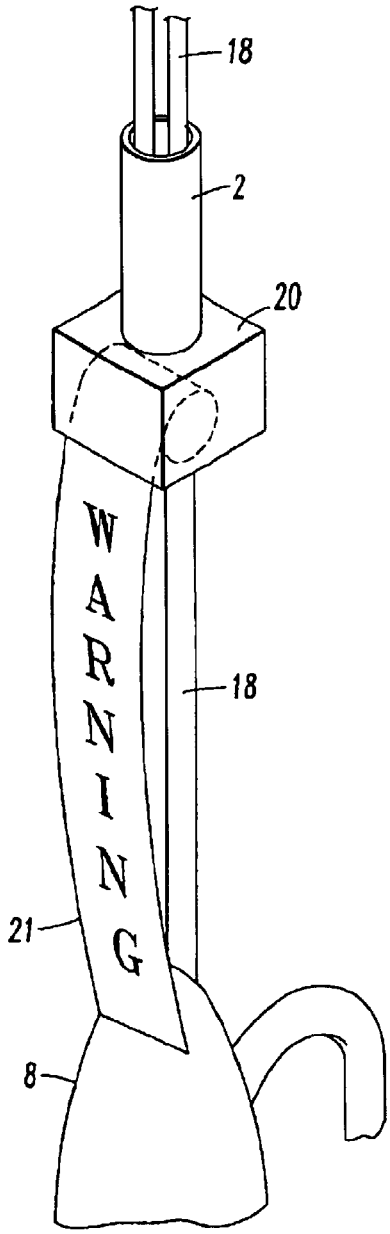
FIG. 17 is a perspective view of one embodiment of my cord shroud in which a retractable warning tape is provided.

Manufacturers of window coverings in the United States have been placing warning labels on their products to address child safety concerns. Often the purchaser or installer removes these labels and the warnings are soon forgotten. In the embodiment of FIG. 17 a housing 20 is provided at the end of the tube 2 that extends from the headrail. This housing contains a warning tape wound on a spring-loaded spool. The end of the warning tape is attached to the gripper 8. When the operator pulls the gripper down the warning tape 21 is pulled from the housing 20 to display its message. That warning tape is retracted into the housing 20 when the gripper 8 is returned to its original position adjacent the housing 20.

Although I have shown and described certain present preferred embodiments of my cord shroud for lift cords and cord loops, it should be understood that the invention is not limited thereto, but may be various embodied within the scope of the following claims.

I claim:

1. A cord shroud for use in cooperation with a window covering device of the type having a plurality of lift cords extending from a headrail, the lift cords used to raise and lower a window covering material, the cord shroud comprising:

a first elongated flexible ribbon having a first end, a second end, and a plurality of apertures, the apertures sized to permit the lift cords to pass through the apertures;

a second elongated flexible ribbon having a first end, a second end, and a plurality of apertures, the apertures sized to permit the lift cords to pass through the apertures; and a gripper attached to the second end of the first ribbon, attached to the first end of the second ribbon, and having a passageway through which the lift cords can pass, the gripper being of a size and shape and made of a material such that the cords can pass freely through the passageway when the gripper is in a relaxed condition and the gripper will grip a portion of the lifts cords that is in the passageway when a force is applied to the gripper.

2. The cord shroud of claim 1 also comprising a tube attached to the first end of the first ribbon in a manner so that the apertures in the first ribbon will be aligned with a passageway through the tube.

3. The cord shroud of claim 1 also comprising a finger loop attached to the gripper.

4. The cord shroud of claim 1 wherein the gripper is made of a flexible material.

5. The cord shroud of claim 4 wherein the gripper is a hollow ellipsoid shape having opposite ends and the passageway runs through the opposite ends.

6. The cord shroud of claim 1 wherein the gripper contains a cam lock positioned to grip and release lift cords in the passageway.

7. The cord shroud of claim 1 also comprising a cord reel attached to the second end of the second ribbon.

8. The cord shroud of claim 1 also comprising a cord tassel attached to the second end of the second ribbon.

9. The cord shroud of claim 1 wherein at least one of the first ribbon and the second ribbon is configured as a ladder having a pair of generally parallel side rails and a plurality of rungs connected between the side rails, the rungs and the side rails defining the plurality of apertures.

10. The cord shroud of claim 1 wherein the gripper has a return path through which the lift cords can freely pass when the gripper is in a relaxed condition and when a force is applied to the gripper so that the gripper will grip a portion of the lift cords within the passageway.

11. The cord shroud of claim 1 wherein at least one of the first ribbon and the second ribbon is pleated so as to have a series of transverse pleats provided thereon alternately oriented in opposite directions.

12. The cord shroud of claim 1 wherein the ribbon is made of at least one of fabric, plastic, paper and a combination thereof.

13. The cord shroud of claim 1, further comprising a plurality of spaced-apart loops attached to at least one of the first ribbon and the second ribbon of material and wherein the apertures in that ribbon are formed by the plurality of loops.

14. The cord shroud of claim 13 wherein each loop is shaped and attached to the ribbon in a manner to form at least two apertures.

15. The cord shroud of claim 13 wherein the plurality of spaced-apart loops are spaced-apart rings attached to at least one of the first ribbon and the second ribbon, wherein the plurality of apertures in that ribbon are formed by the rings.

16. The cord shroud of claim 1 wherein the flexible ribbon is a section of material having a plurality of spaced-apart holes provided through the ribbon, wherein the holes form the apertures.

17. A cord shroud for use in cooperation with a window covering device of the type having a plurality of lift cords extending from a headrail, the lift cords used to raise and lower a window covering material, the shroud comprising:

a first cord capture device comprised of a first cord having a plurality of loops aligned so that the lift cords may pass through the loops, the first cord having a first end and a second end;

a second cord capture device having a first end and a second end, the second cord capture device being a second cord having a plurality of loops aligned so that the lift cords may pass through the loops, or being an elongated flexible ribbon having a plurality of apertures, the apertures sized to permit lift cords to pass through the apertures; and a gripper attached to the second end of the first cord, attached to the first end of the second cord capture device, and having a passageway through which the lift cords pass, the gripper being of a size and shape and made of a material such that the cords can pass freely through the passageway when the gripper is in a relaxed condition and the gripper will grip a portion of the lifts cords that is in the passageway when a force is applied to the gripper.

18. The cord shroud of claim 17 wherein the first cord having a plurality of loops is comprised of a base cord having a plurality of spaced-apart loops attached to the base cord.

19. The cord shroud of claim 17 wherein the first cord having a plurality of loops is a coiled cord.

20. The cord shroud of claim 17 also comprising a release cord having a release handle at one end, the handle being attached to the first end of the first cord having a plurality of aligned loops.

21. The cord shroud of claim 20 also comprising a collector attached to the gripper, the collector sized and positioned to receive at least a portion of the first cord having a plurality of loops.

22. A cord shroud for use in cooperation with a window covering device of the type having a plurality of lift cords extending from the headrail, the lift cords being used to raise and lower a window covering material, the shroud comprising:

a first cord capture device comprised of a collapsible tube having a first end and a second end and sized to permit lift cords to pass through the collapsible tube;

a second cord capture device having a first end and a second end, the second cord capture device being one of a second collapsible tube having a first end and a second end and sized to permit lift cords to pass through the second collapsible tube, a second cord having a plurality of loops aligned so that the lift cords may pass through the loops, and an elongated flexible ribbon having a plurality of apertures, the apertures sized to permit lift cords to pass through the apertures; and a gripper attached to the second end of the collapsible tube, attached to the first end of the second cord capture device, and having a passageway through which the lift cords pass, the gripper being of a size and shape and made of a material such that the cords can pass freely through the passageway when the gripper is in a relaxed condition and the gripper will grip a portion of the lifts cords that is in the passageway when a force is applied to the gripper.

23. An improved window covering having a plurality of lift cords extending from a headrail to an end of each lift cord, the lift cords used to raise and lower a window covering material, wherein the improvement comprises a cord capture device having a fixed end and a moveable end, the cord capture device being selected from the group consisting of a ribbon having a plurality of apertures through which the lift cords pass, a cord having a plurality of loops attached to the cord and through which loops the lift cords pass, a one piece collapsible tube made of flexible material through which the lift cords pass, a ladder having rungs through which the lift cords pass, and a coiled cord defining loops through which the lift cords pass, the fixed end being attached to a point which is spaced apart from and fixed relative to the headrail, the moveable end being moveable relative to the headrail, relative to all points on the lift cords and relative to the point which is fixed relative to the headrail.

24. The improved window covering of claim 23 also comprising a gripper attached to the moveable end of the cord capture device, the gripper having a passageway through which the lift cords pass, the gripper being of a size and shape and made of a material such that the lift cords pass freely through the passageway when the gripper is in a relaxed condition and the gripper will grip a portion of the lifts cords that is in the passageway when a force is applied to the gripper.

25. The improved window covering of claim 24 also comprising a second cord capture device having a first end and a second end, the first end attached to the gripper and the second cord capture device being selected from the group consisting of a ribbon having a plurality of apertures through which the lift cords pass, a cord having a plurality of loops attached to the cord and through which loops the lift cords pass, a collapsible tube through which the lift cords pass, a ladder having rungs through which the lift cords pass, and a coiled cord defining loops through which the lift cords pass.

26. The improved window covering of claim 24 also comprising a cord lock within the headrail and through which the lift cords pass and a release cord having one end attached to the cord lock and a second end positioned at the point located at a selected distance from the headrail, the fixed end of the cord capture device being attached to the second end of the release cord.

27. The improved window covering of claim 24 also comprising an elastic cord having one end attached to the headrail and an opposite end connected to the gripper.

28. The improved window covering of claim 24 also comprising a finger loop attached to the gripper.

29. The improved window covering of claim 24 wherein the gripper is made of a flexible material.

30. The improved window covering of claim 24 wherein the gripper is a hollow ellipsoid shape having opposite ends and the passageway runs through the opposite ends.

31. The improved window covering of claim 24 wherein the gripper contains a cam lock positioned to grip and release lift cords in the passageway.

32. The improved window covering of claim 24 wherein the gripper his a return path through which the lift cords can freely pass when the gripper is in a relaxed condition and when a force is applied to the gripper so that the gripper will grip a portion of the lift cords within the passageway.

33. The improved window covering of claim 23 also comprising an elastic cord having one end attached to the headrail and an opposite end connected to the moveable end of the cord capture device.

34. The improved window covering of claim 23 also comprising a tube attached to the headrail and through which the lift cords pass, the fixed end of the cord capture device being attached to the tube.

35. The improved window covering of claim 23 also comprising a cord reel attached to the movable end of the cord capture device.

36. The improved window covering of claim 23 also comprising a cord tassel attached to the movable end of the cord capture device.

37. The improved window covering of claim 23 wherein the cord capture device is a ribbon, the ribbon being pleated so as to have a series of transverse pleats provided thereon alternately oriented in opposite directions.

38. The improved window covering of claim 23 wherein the cord capture device is a ribbon made of at least one of fabric, plastic, paper and a combination thereof.

39. The improved window covering of claim 35 further comprising a plurality of spaced-apart loops attached to the ribbon and wherein the apertures in that ribbon are formed by the plurality of loops.

40. The improved window covering of claim 36 wherein each loop is shaped and attached to the ribbon in a manner to form at least two apertures.

41. The improved window covering of claim 36 wherein the loops are spaced-apart rings and wherein the rings form the plurality of apertures in the ribbon.

42. The improved window covering of claim 23 wherein the cord capture device is a flexible ribbon formed from a section of material having a plurality of spaced-apart. holes provided through the ribbon, wherein the holes form the apertures.

43. The improved window covering of claim 23 also comprising a warning tape attached to the moveable end of the cord capture device.

44. The improved window covering of claim 40 also comprising a tape reel to which one end of the warning tape is attached and on which the warning tape is wound and unwound as the moveable end of the cord capture device is moved relative to the lift cords.

45. The improved window covering of claim 23 wherein the plurality of lift cords is a cord loop and the end of at least one lift cord is an end of the cord loop.

* * * * *